US006416300B1

(12) United States Patent
Tang et al.

(10) Patent No.: US 6,416,300 B1
(45) Date of Patent: Jul. 9, 2002

(54) COOLING FAN STRUCTURE

(75) Inventors: Ping-Huey Tang, Yung-Ho; Chi-Wei Tien, Tai-Ping; Hsin-Pu Chen, Taichung, all of (TW)

(73) Assignee: Hsin-Mao Hsieh, Kaohsiung (TW)

( * ) Notice: Subject to any disclaimer, the term of this patent is extended or adjusted under 35 U.S.C. 154(b) by 4 days.

(21) Appl. No.: 09/641,524

(22) Filed: Aug. 21, 2000

(51) Int. Cl.[7] ..... F04B 17/00
(52) U.S. Cl. ..... 417/423.12
(58) Field of Search ..... 417/423.12, 423.1, 417/375, 321; 384/265, 441

(56) References Cited

U.S. PATENT DOCUMENTS 3,969,042 A * 7/1976 Bachler ..... 417/354
4,032,261 A * 6/1977 Madan ..... 417/366
4,115,038 A * 9/1978 Litzenberg ..... 417/357
4,355,850 A * 10/1982 Okano ..... 384/121
4,969,797 A * 11/1990 Takara et al. ..... 415/113
5,028,216 A * 7/1991 Harmsen et al. ..... 417/354
5,114,317 A * 5/1992 Cohen ..... 417/354
5,129,795 A * 7/1992 Hyland ..... 417/423.12
5,569,023 A * 10/1996 Ishida et al. ..... 417/326
5,668,421 A * 9/1997 Gladish ..... 310/12
5,835,195 A * 11/1998 Gibson et al. ..... 355/53
5,893,705 A * 4/1999 Khan et al. ..... 417/354
5,924,851 A * 7/1999 Obata et al. ..... 417/424.1

* cited by examiner

*Primary Examiner*—Teresa Walberg
*Assistant Examiner*—Daniel Robinson
(74) *Attorney, Agent, or Firm*—Rosenberg, Klein & Lee

(57) ABSTRACT

A cooling fan structure installed in a system or a device necessitating radiation, cooling or convection, especially applied to the central processing unit of a computer for forced convection. The cooling fan structure includes a fixed base seat, a rotary vane assembly and a protective cover. The vane assembly and the fixed base seat contact with each other at one single point and an air bearing is formed to retain the vane assembly so that almost no contact abrasion will take place and the noise is minimized and the rotational speed can be increased. The cooling fan structure is manufactured at low cost and can be easily assembled.

1 Claim, 8 Drawing Sheets

COOLING FAN STRUCTURE

BACKGROUND OF THE INVENTION

The present invention relates to an improved cooling fan structure, and more particularly to a cooling fan structure. In which, the vane assembly and the fixed base seat contact with each other at one single point and an air bearing is formed to retain the vane assembly so that almost no contact abrasion will take place and the noise is minimized and the rotational speed can be increased. The cooling fan structure is manufactured at low cost and can be easily assembled.

FIG. 1 shows a conventional cooling fan with ball bearings, including a vane structure 11, a magnet 12, a stator 13, a sleeve 14, a circuit board 15, two ball bearings 16, a thrust spring 17, a thrust washer 18 and a housing 19. The ball bearings 16 serve to retain the vane structure 11 in operation. In high speed operation, the central shaft of the vane structure 11 contacts with and abrade the ball bearings 16. This leads to great noise and makes it impossible to increase the rotational speed.

Moreover, most of such cooling fans are used inside a computer for cooling the electronic elements so that such cooling fan has small volume (the cross-section thereof is generally smaller than the top face of the central processor of the computer, that is, smaller than 12×12 cm). As a result, the bearings employed in such cooling fan have even smaller volume. Therefore, the bearings must have very high precision so that the cost is relatively high and it is troublesome to assemble the bearings.

SUMMARY OF THE INVENTION

It is therefore a primary object of the present invention to provide an improved cooling fan structure. In which, the vane assembly and the fixed base seat contact with each other at one single point and an air bearing is formed to retain the vane assembly so that almost no contact abrasion will take place and the noise is minimized and the rotational speed can be increased.

It is a further object of the present invention to provide the above cooling fan structure that is manufactured at low cost and can be easily assembled.

The present invention can be best understood through the following description and accompanying drawings wherein:

DETAILED DESCRIPTION OF THE PREFERRED EMBODIMENTS

Figure 1:
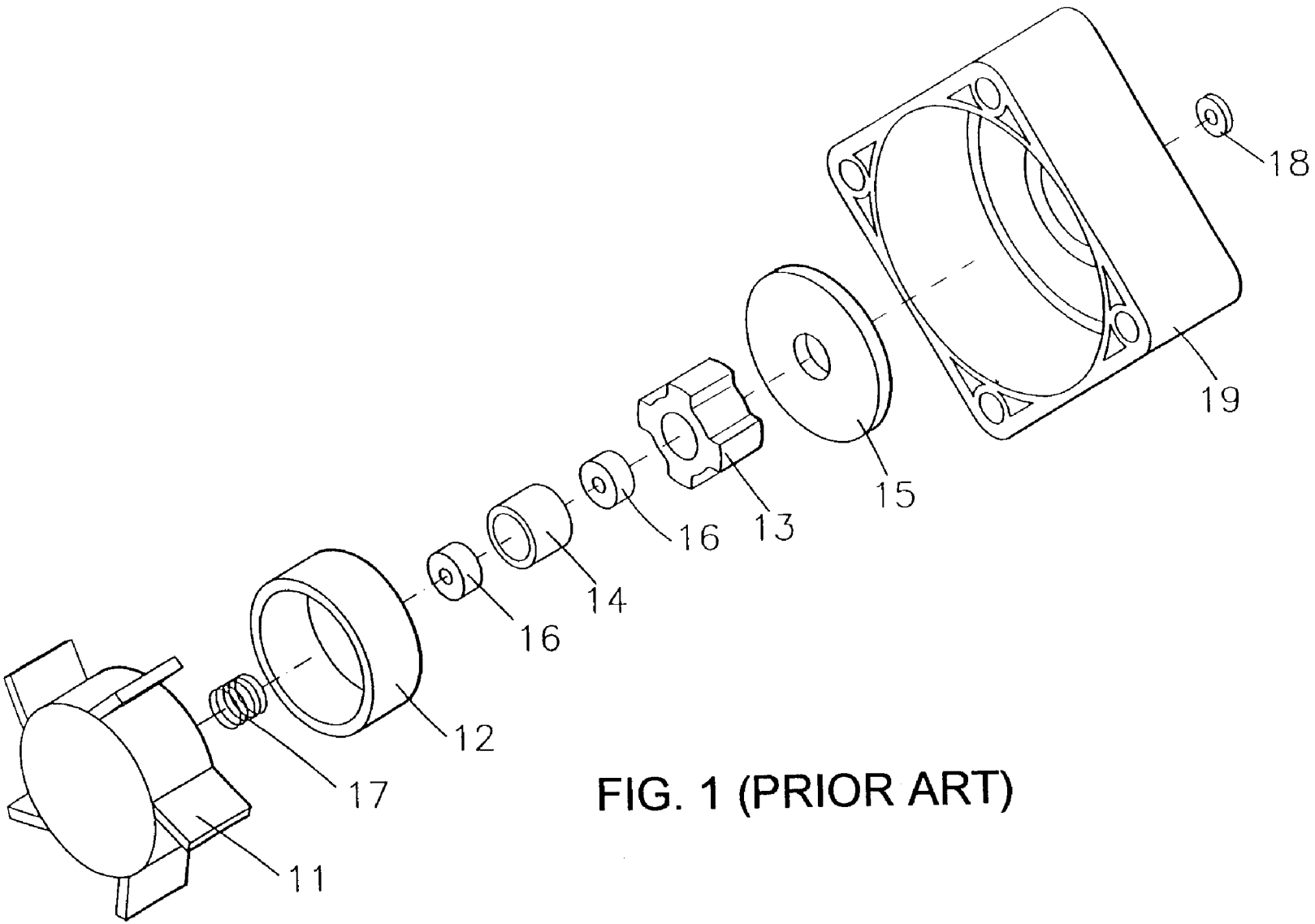
FIG. 1 (PRIOR ART)
FIG. 1 is a perspective exploded view of a conventional cooling fan with ball bearings.
Figure 2:
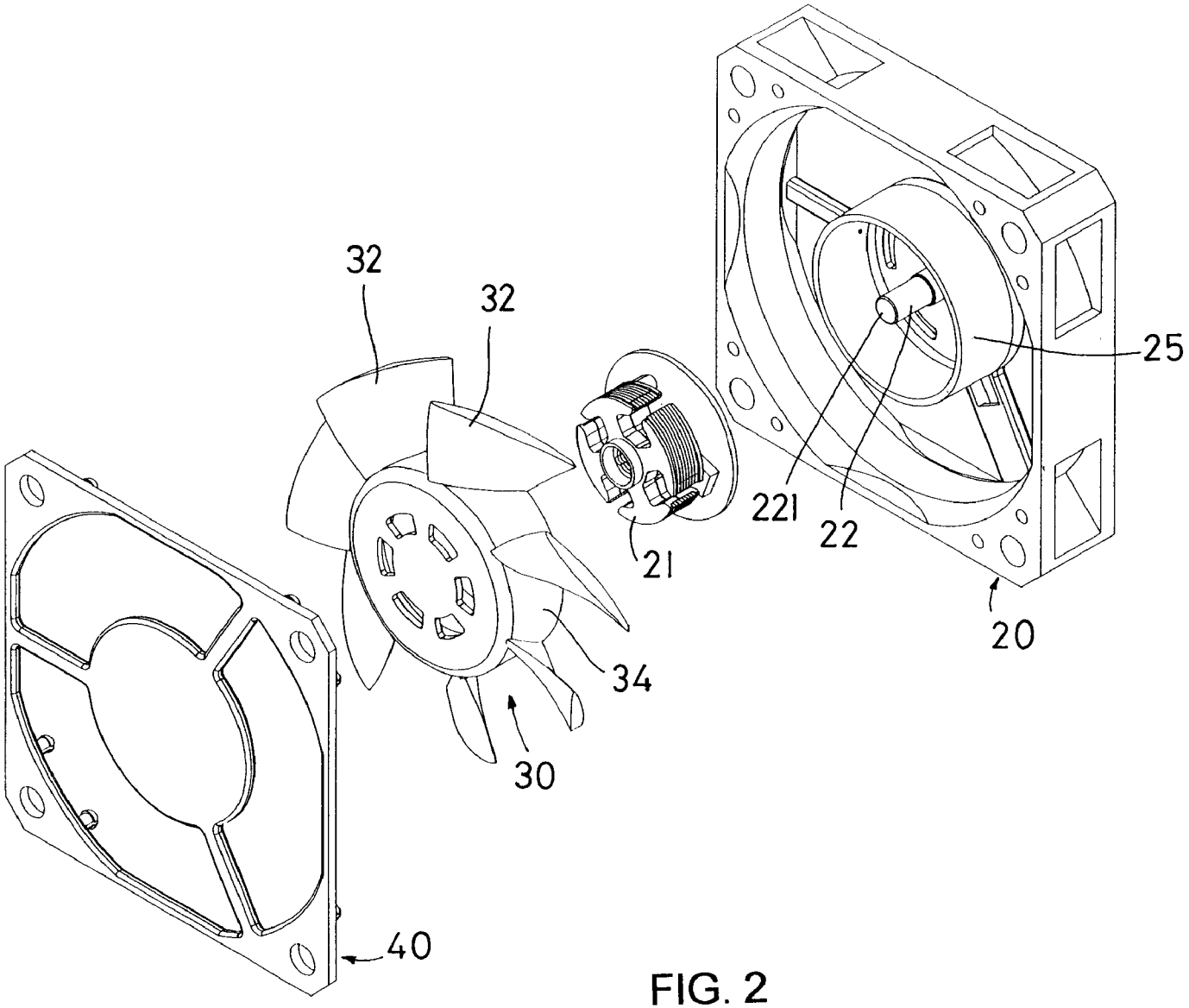
FIG. 2 is a perspective exploded view of a first embodiment of the present invention.
Figure 3:
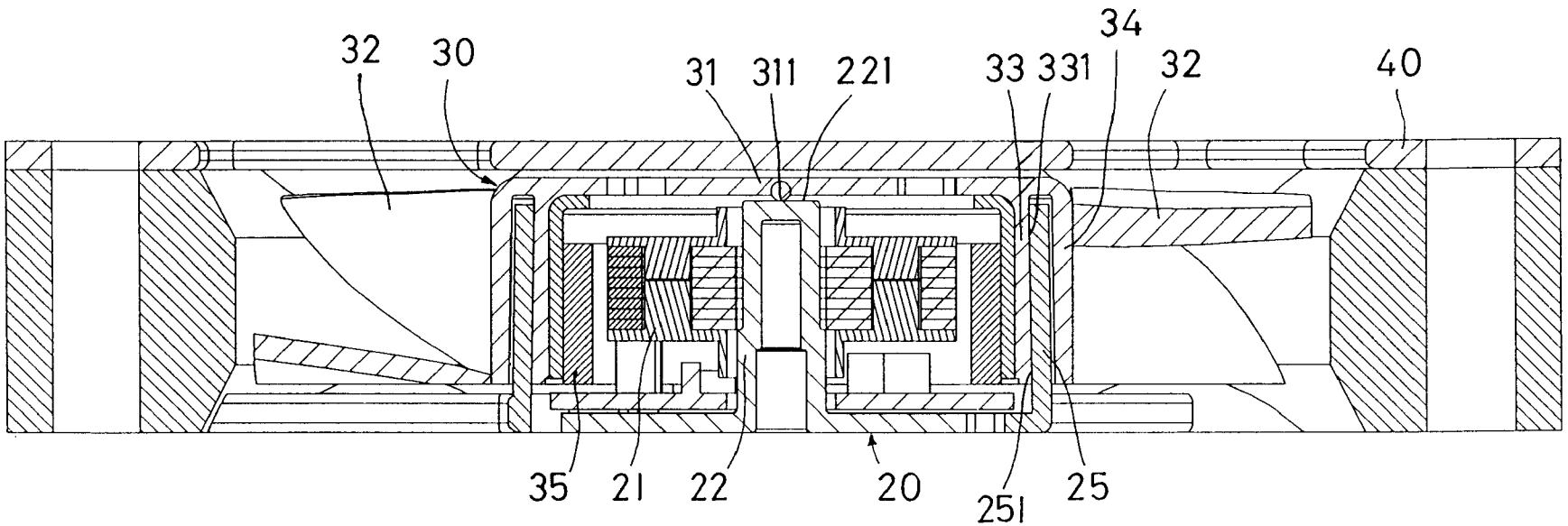
FIG. 3 is a sectional assembled view of the first embodiment of the present invention.

The cooling fan structure of the present invention is installed in a system or device necessitating radiation, cooling or convection, especially applied to the central processing unit (CPU) of a computer for forced convection. With respect to the volume, the present invention pertains to small-size cooling fan (the cross-section thereof is generally smaller than the top face of the central processor of the computer, that is, smaller than about 12×12 cm). FIGS. 2 and 3 show a first embodiment of the present invention, including a fixed base seat 20, a rotary vane assembly 30 and a protective cover 40.

A stator assembly 21 is mounted on the fixed base seat 20. A central section 22 of the base seat 20 has an anti-abrasive first contact section 221. The base seat 20 further has a first annular section 25 substantially parallel to (or coaxial with) the central section 22. The first annular section 25 has a first air bearing annular face 251.

The vane assembly 30 is rotarily driven by the stator assembly 21, including a magnetism generating section 35, a central portion 31, multiple vanes 32 and a second annular section 33. The central portion 31 has an anti-abrasive second contact section 311. The second annular section 33 corresponds to the first annular section 25 and has a second air bearing annular face 331.

The protective cover 40 serves to prevent the vane assembly 30 from detaching from the base seat 20. The protective cover 40 can be omitted if it is necessary.

The magnetism generating section 35 of the vane assembly 30 and the stator 21 of the base seat 20 magnetically attract each other to make the first contact section 221 and the second contact section 311 contact with each other at one single point. In addition, a predetermined very small gap exists between the first air bearing annular face 251 of the first annular section 25 and the second air bearing annular face 331 of the second annular section 33. The gap is preferably within 5 to 40 micrometers. When the vane assembly 30 rotates, the predetermined gap serves as an air film to achieve an air bearing effect.

In this embodiment, the first contact section 221 is an anti-abrasive embedded steel ball (or an integrally formed convex face), while the second contact section 311 is an anti-abrasive plane face. Alternatively, both can be steel balls or convex faces.

Furthermore, a third annular section 34 can be disposed on outer side of the second annular section 33. Multiple vanes 32 are arranged on the third annular section 34. However, the gap between the first annular section 25 and the third annular section 34 is much larger than the very small gap between the first air bearing annular face 251 of the first annular section 25 and the second air bearing annular face 331 of the second annular section 33. Alternatively, the gap between the first and third annular sections 25, 34 can be very small, while the gap between the first annular section 25 and the second annular section 33 is larger.

Figure 4:
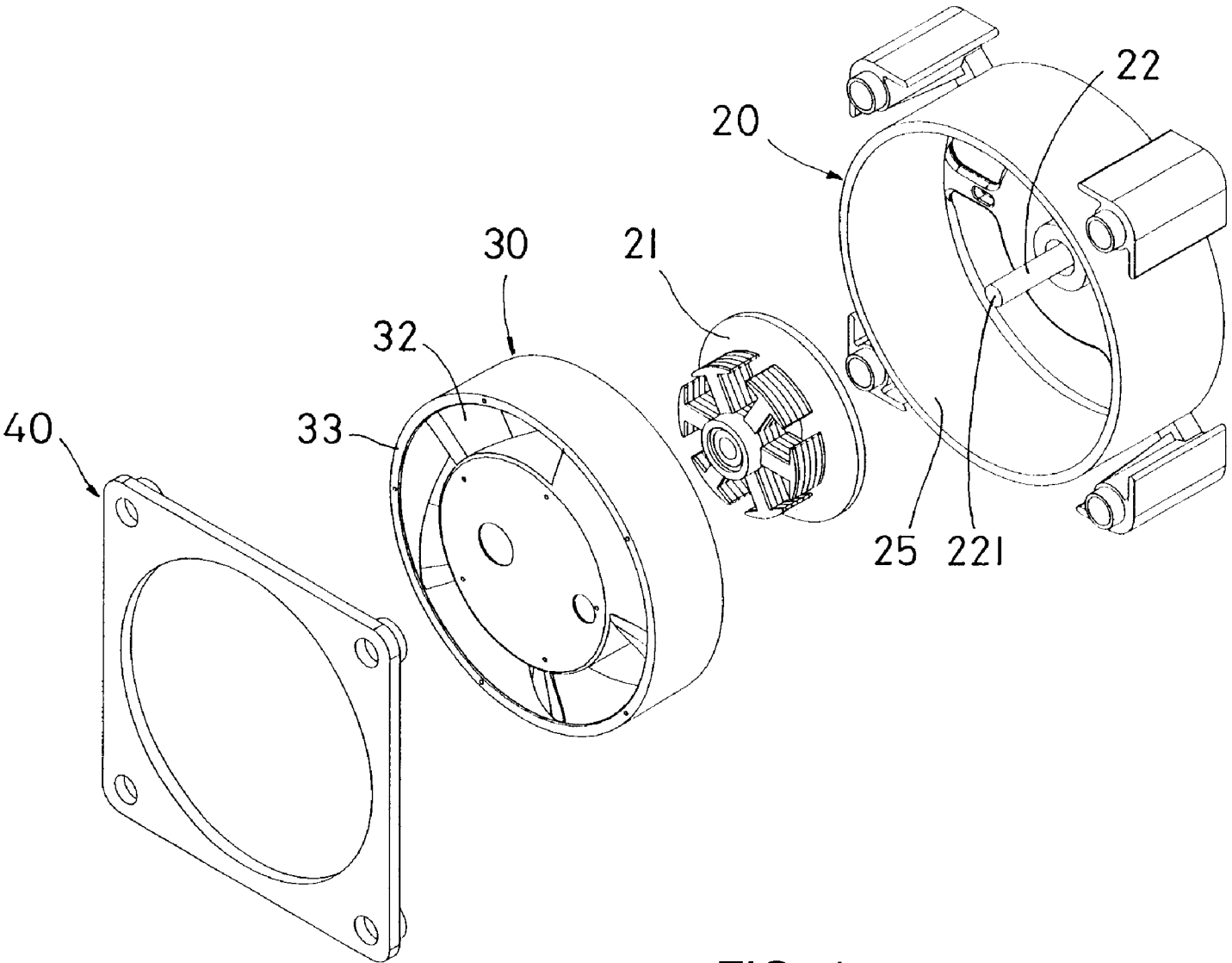
FIG. 4 is a perspective exploded view of a second embodiment of the present invention.
Figure 5:
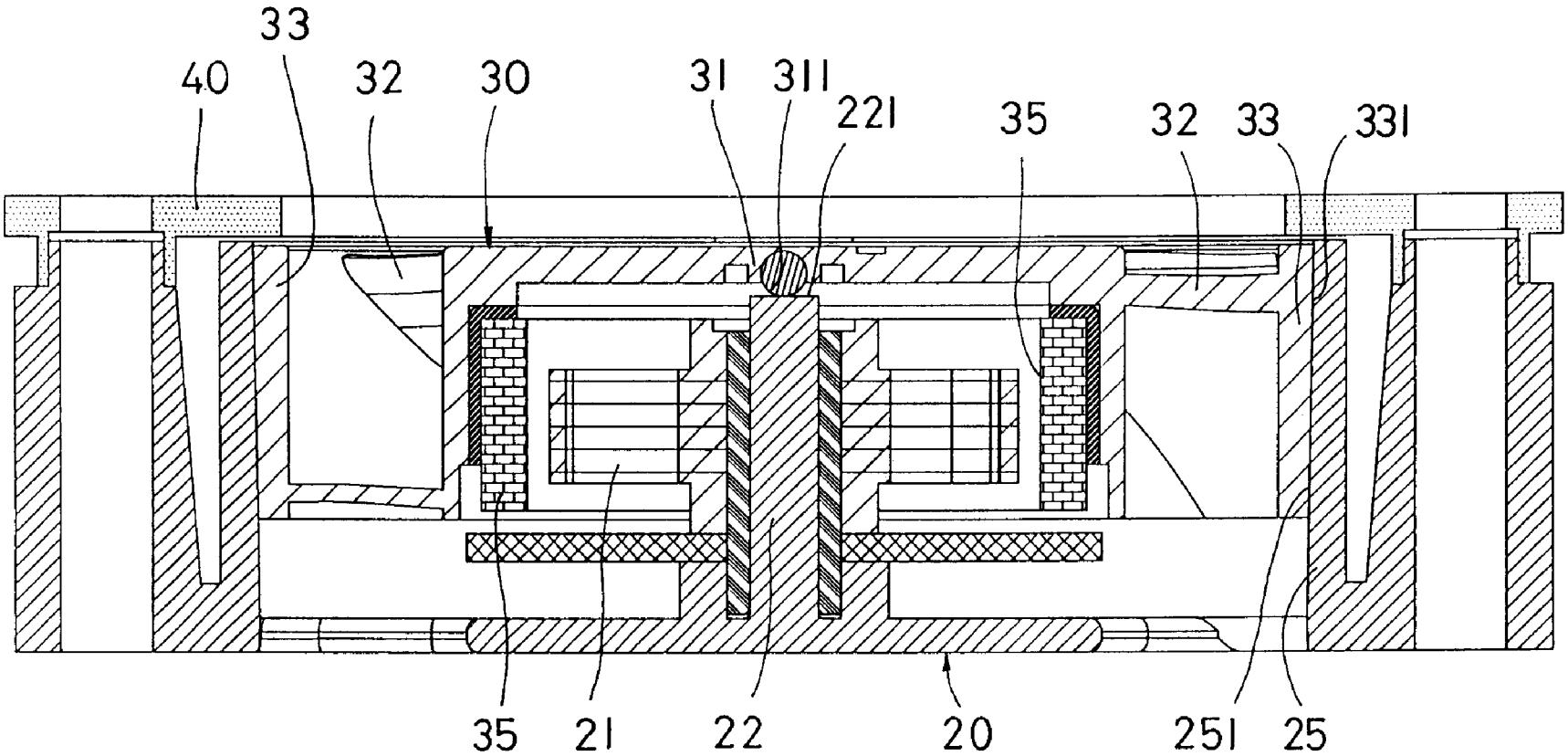
FIG. 5 is a sectional assembled view of the second embodiment of the present invention.
Figure 6:
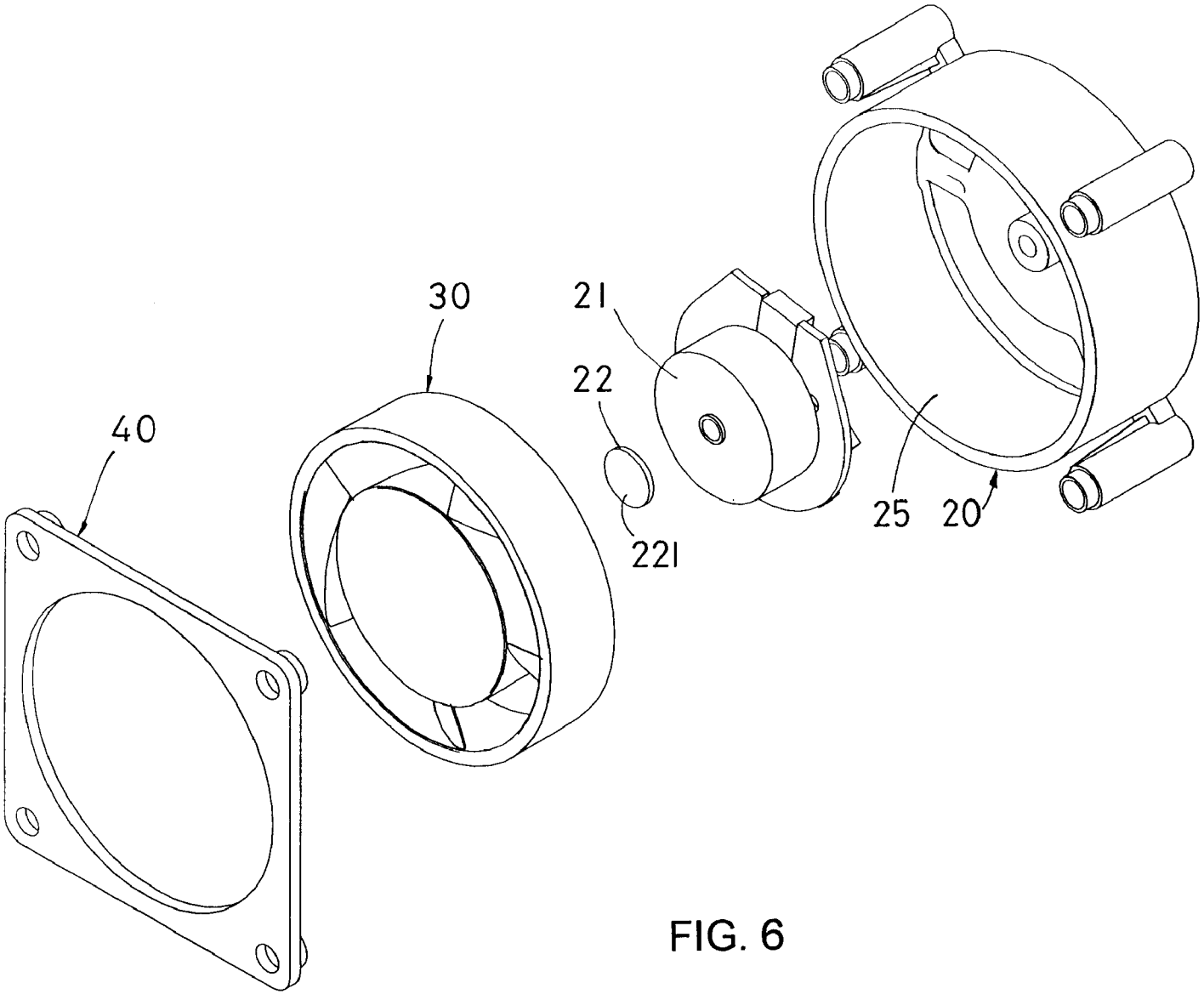
FIG. 6 is a perspective exploded view of a third embodiment of the present invention, seen in one direction.
Figure 7:
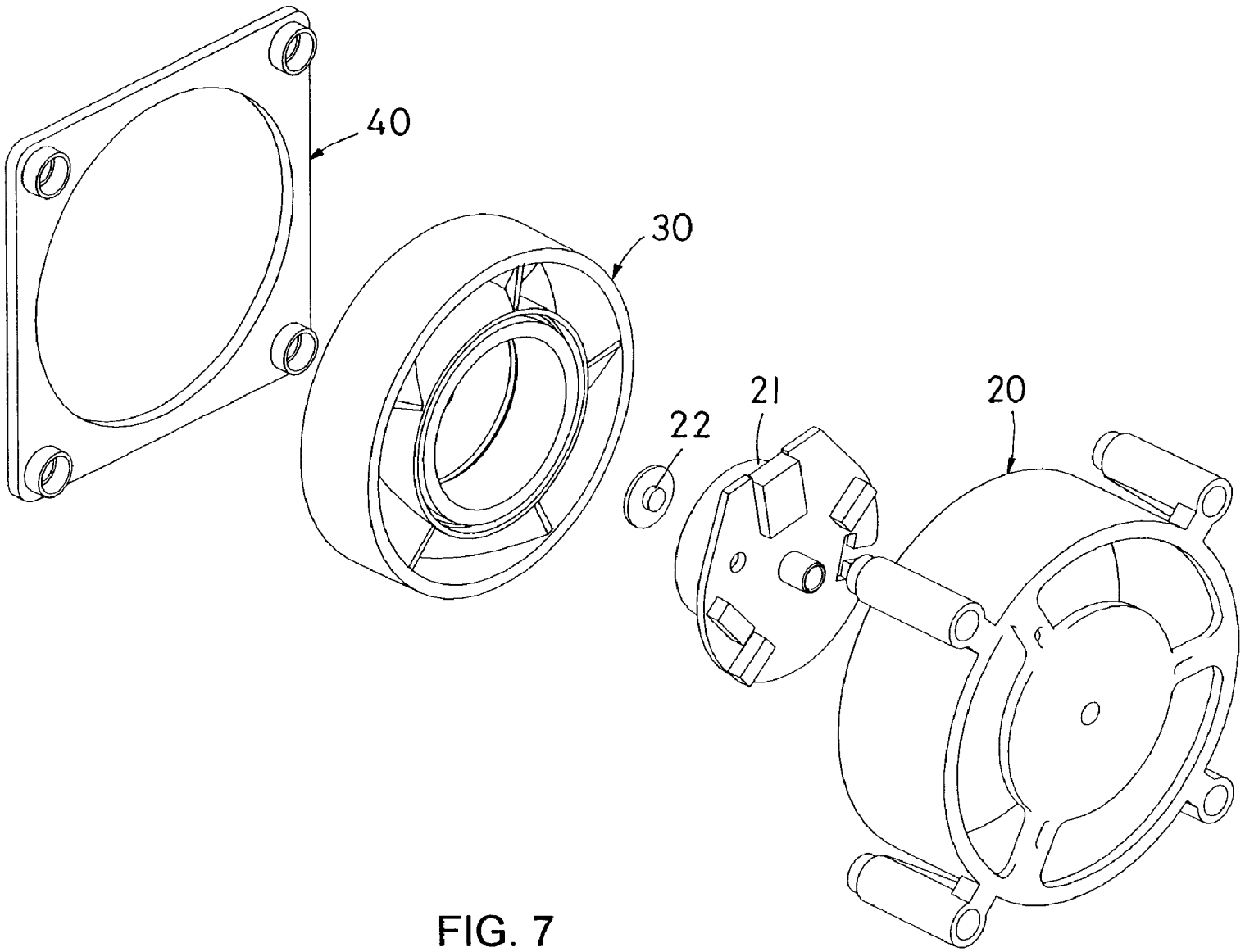
FIG. 7 is a perspective exploded view of the third embodiment of the present invention, seen in another direction.
Figures 8, 9:
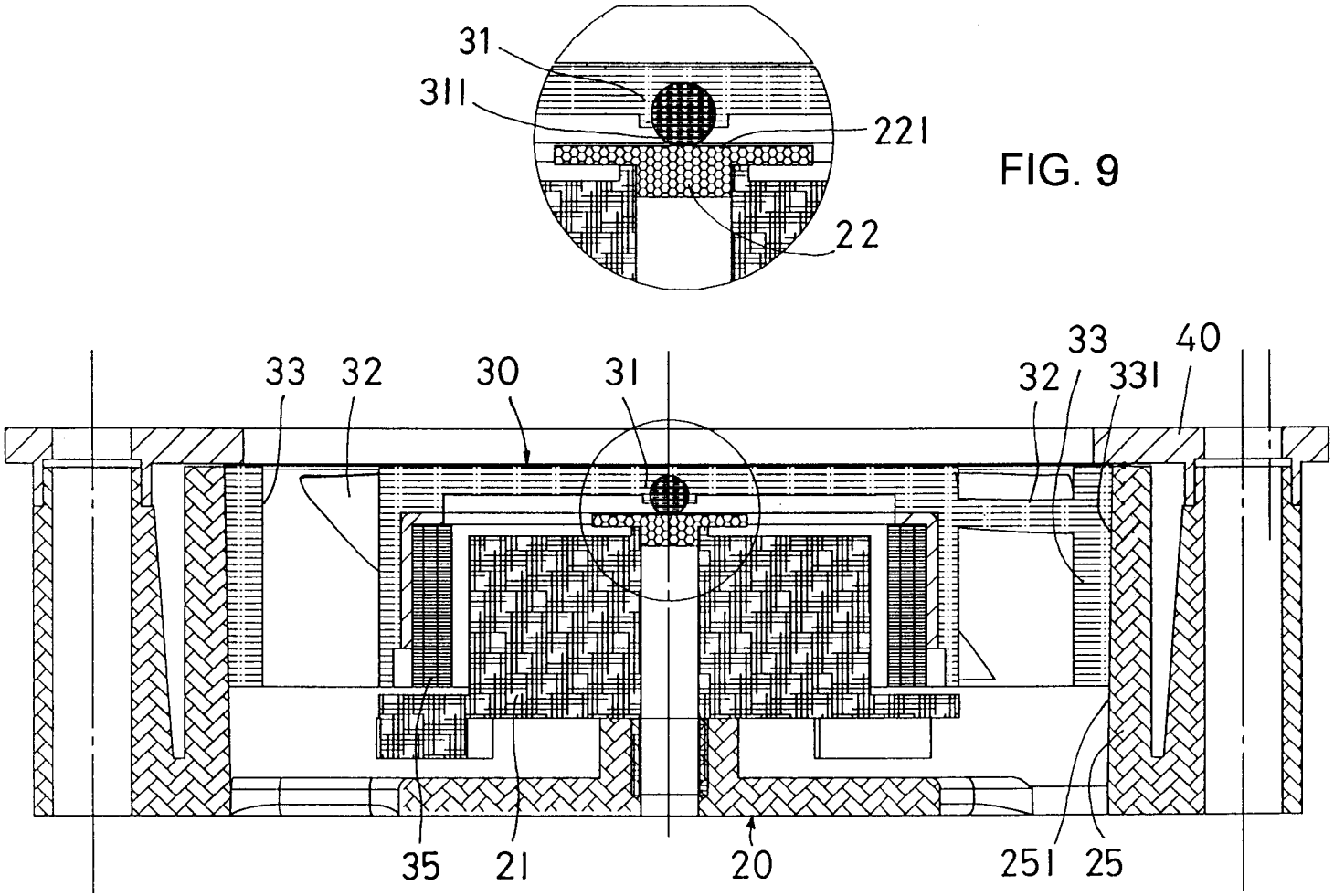
FIG. 8 is a sectional assembled view of the third embodiment of the present invention.
FIG. 9 is an enlarged view of the marked area of FIG. 8.

The first and second annular sections 25, 33 can be at least positioned in two manners. The above first embodiment is "inside-vane type", while a second embodiment of the present invention is "outside-vane type" which will be described as follows:

FIGS. 4 and 5 show the second embodiment of the present invention, in which the first and second annular sections 25, 33 are both disposed on outer side of the vanes 32. Identically, the first contact section 221 and the second contact section 311 contact with each other at one single point. A predetermined very small gap exists between the first air bearing annular face 251 of the first annular section 25 and the second air bearing annular face 331 of the second annular section 33. When the vane assembly 30 rotates, the predetermined gap serves as an air film to achieve an air bearing effect.

FIGS. 6 to 9 show a third embodiment of the present invention, which is basically identical to the second embodiment. The separable central section 22 of the base seat 20 has a shorter length. An anti-abrasive first contact section 221 is disposed on the central section 22 and can be plugged therein. Accordingly, the manufacturing and assembly are facilitated.

One of the central section 22 of the base seat 20 and the central portion 31 of the vane assembly 30 can be an integrally formed shaft or a separable shaft. Also, the other thereof can be an integrally formed plane face or a plane plate which can be plugged in. Both will equivalently achieve the same function.

Furthermore, one of the first contact section 221 and the second contact section 311 can be formed as a protruded shaft or a protruded cone (not shown). In which, one of the protruded tip of the shaft or cone is a spherical face or a convex face. Whereas, the other one is formed as a corresponding recessed hole or cave. The bottom of the hole or case is a plane. Thus, the protruded shaft or cone has a function to ensure the axis alignment. It is still is an equivalent modification.

In addition, the first air bearing annular face 251 and the second air bearing annular face 331 can further be disposed with some predetermined slots (not shown) so that the air bearing will be operated smoother.

According to the above arrangement, the present invention has the following advantages:

1. Almost no contact abrasion will take place so that the noise is minimized and the rotational speed can be increased. This advantage can be achieved because vane assembly 30 and the fixed base seat 20 contact with each other at one single point and the air bearing is formed to retain the vane assembly 30.
2. The manufacturing cost is low and the assembly is simple. The conventional sleeve 14, ball bearings 16, thrust spring 17 and thrust washer 18 are omitted so that the cost is lowered and the assembly is facilitated.

The above embodiments are only used to illustrate the present invention, not intended to limit the scope thereof. Many modifications of the above embodiments can be made without departing from the spirit of the present invention.

What is claimed is:

1. A cooling fan structure comprising:

a fixed base seat on which a stator assembly is mounted, a central section of said base seat having an anti-abrasion first contact section, said base seat having a first annular section positioned substantially parallel to said central section, said first annular section having a first air bearing annular face; and, a vane assembly rotationally driven by said stator assembly, said vane assembly having a magnetic section, a central portion, multiple vanes, and a second annular section, said central portion having an anti-abrasion second contact section, said second annular section corresponding to said first annular section and having a second air bearing annular face, wherein said first contact section and said second contact section contact one another at a single point with a gap formed between said first air bearing annular face of said first annular section and said second air bearing annular face of said second annular section, said gap having a width between 5 and 40 micrometers, said gap serving as an air film to achieve an air bearing effect when said vane assembly rotates.

* * * * *